United States Patent [19]

Oberstrass

[11] 4,372,106

[45] Feb. 8, 1983

[54] DRIVE SYSTEM FOR YARN FALSE TWISTING APPARATUS

[75] Inventor: Detlev Oberstrass, Tönisheide, Fed. Rep. of Germany

[73] Assignee: Barmag Barmer Maschinenfabrik AG, Remscheid, Fed. Rep. of Germany

[21] Appl. No.: 272,940

[22] Filed: Jun. 12, 1981

[30] Foreign Application Priority Data

Jun. 14, 1980 [DE] Fed. Rep. of Germany ..... 3022421
Dec. 23, 1980 [DE] Fed. Rep. of Germany ..... 3048615

[51] Int. Cl.[3] ..... D02G 1/08

[52] U.S. Cl. ..... 57/334; 57/105; 57/339; 57/340; 57/348

[58] Field of Search ..... 57/334-340, 57/348, 349, 104, 105

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,240,248 | 12/1980 | Raschle | 57/338 |
| 4,248,038 | 2/1981 | Takai | 57/348 X |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes
*Attorney, Agent, or Firm*—Bell, Seltzer, Park & Gibson

[57] ABSTRACT

A drive system for a yarn false twisting apparatus is disclosed which may be readily converted to produce either S or Z twist, and which insures adequate tension of the drive belt. The apparatus comprises a pair of twist imparting members, and a drive belt system for rotating the twist imparting members which comprises a drive whorl positioned to engage a tangential belt, and a series of pulleys having a drive belt entrained thereabout for rotatably interconnecting the whorl and twist imparting members. The whorl and one of the pulleys are mounted coaxially on a whorl support member, which may be selectively positioned in one of two operating positions to place the whorl on opposite sides of the tangential belt. Another of the pulleys is an idler pulley, which is adjustably mounted for movement in a direction perpendicular to the yarn path of travel and so as to permit maintenance of an adequate tension on the drive belt.

22 Claims, 7 Drawing Figures

DRIVE SYSTEM FOR YARN FALSE TWISTING APPARATUS

Figure 1:
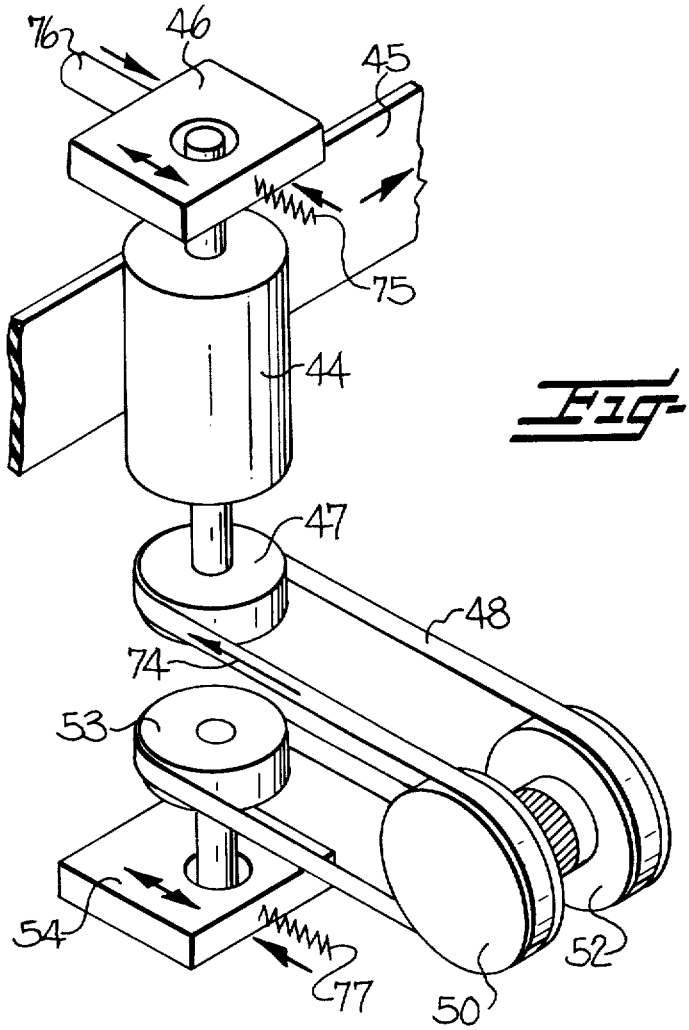

The present invention relates to an improved yarn false twisting apparatus, of the type disclosed in commonly owned copending applications Ser. Nos. 168,734, now U.S. Pat. No. 4,339,915, and 168,735, now abandoned, both filed on July 14, 1980.

In copending application Ser. No. 168,734, there is disclosed an apparatus for false twisting a yarn which comprises a thin flexible or pliable disc mounted for rotation with a cooperating disc or roller to define a twisting zone between opposing friction surfaces thereof. A pressure applying member is mounted adjacent the back face of the flexible disc for biasing the disc toward the other member locally at the twisting zone so as to firmly engage the yarn passing through the twisting zone, and while the friction surfaces remain in substantially non-contacting relationship with respect to each other. As a result, the yarn contacts the friction surfaces only in the narrowly limited and defined twisting zone. One particular advantage of this prior false twisting apparatus is the fact that the apparatus not only twists the yarn, but also effects its conveyance through the twisting zone.

In copending application Ser. No. 168,735, there is disclosed a friction false twisting apparatus which comprises a pair of endless belts mounted for rotation to define a twisting zone between opposing friction surfaces thereof. A pressure applying member is mounted adjacent the back of at least one of the belts for biasing the belt toward the other belt locally at the twisting zone and so as to firmly engage the yarn passing therethrough.

German Pat. No. 1,192,779 also discloses a friction false twisting apparatus, and wherein each of the friction surfaces includes a drive pulley. A single drive belt loops about a main whorl, which has an upper and lower belt pulley mounted at its opposite ends. The belt then loops the pulleys associated with the friction surfaces, which defines an upper rotating plane defined by the upper belt pulley, and a lower rotating plane defined by the lower belt pulley. A disadvantage of this drive is the fact that to produce both an S twist and a Z twist, different constructions of the false twist apparatus must be made, and in particular, an adequate tension of the belt cannot be readily maintained upon varying the crossing angle of the surfaces and the ratio of twist to yarn conveyance.

The same problem exists in the embodiment of a false twisting apparatus as shown in copending application Ser. No. 168,735. In such case, it is desirable to associate one of the rollers mounting each of the pair of belts to a whorl. However, the prior art does not disclose a belt drive system for such an apparatus which insures the ability to switch between S and Z twist without changing the thread line, and in addition, which permits an adjustment of the crossing angle while maintaining an adequate belt tension.

It is an object of the present invention to provide a belt drive system for a yarn false twisting apparatus which avoids the above noted deficiencies of the prior constructions.

These and other objects and advantages of the present invention are achieved in the embodiments illustrated herein by the provision of a false twisting apparatus which comprises a pair of twist imparting members, means mounting the members for rotational movement wherein portions of the surfaces thereof are disposed in opposing relationship and define a twisting zone therebetween, and drive means for operatively rotating each of the members, and such that a yarn may be advanced along a path of travel through the twisting zone while having twist imparted thereto. In accordance with the present invention, the drive means includes a belt pulley operatively connected to each of the twist imparting members, a main drive whorl rotatably mounted in a whorl support member, a drive pulley rotatably mounted in the whorl support member and operatively connected to the drive whorl for rotation about parallel axes, and an idler pulley. A drive belt operatively interconnects the belt pulleys of the twist imparting members, the drive pulley, and the idler pulley, for effecting concurrent rotation thereof. In addition, the whorl support member and the idler pulley are adjustably mounted for movement with respect to each other in a direction perpendicular to the yarn path of travel, to thereby assure maintenance of an adequate tension in the drive belt.

It is preferred that the main whorl and the drive pulley be fixedly connected to each other on a common axis, and that the support member mounting the main whorl and drive pulley is separate from the idler pulley, and such that the support member and the idler pulley are adapted to move essentially perpendicular to the thread line, and to be positioned in at least two operative settings. By this arrangement, it can be achieved that at each relative position of the friction surfaces, an adequate tension of the drive belt is maintained, and further, that when the twist is changed from S to Z, the main whorl can be placed on the opposite side of the tangential drive belt of the apparatus, without the thread line being essentially changed. Furthermore, the present invention offers the advantage that the main whorl can be easily removed from the tangential belt to temporarily deactivate the friction false twisting apparatus, without having to change the position of the friction false twist apparatus for this purpose.

A preferred embodiment of the invention provides a stop member against which the whorl support member for the main whorl and drive pulley is biased, with the stop member being adjustable between at least two operating positions so that in one position the main whorl is frictionally engaged by the tangential belt of the apparatus, and is positively removed from the belt in the other operating position. However, a reversal of this arrangement is also possible and advantageous, regardless of the tension and elasticity of the tangential belt.

In order to insure that the main whorl is biased with the same force against the tangential belt for both S and Z twist, the suspension of a spring acting on the whorl support member is adapted to be secured in two operating positions on the frame of the apparatus.

In one embodiment which distinguishes itself by a stable, and space saving construction, the whorl support member for the main whorl and the drive pulley is mounted on the free end of a leaf spring, the other end of which is adapted to be firmly fixed to the frame, preferably in one of two selected positions. The leaf spring consists of two leaf spring components which are parallel to each other, and which are joined with each other at their ends in such a manner that they are unable to move relative to each other in the longitudinal direction. Thus it is insured that when the free end is deflected, it always performs a parallel movement to itself.

The fixedly mounted end of the leaf spring is so positioned that when the main whorl rests against the tangential belt at each of the S and Z twist positions, it is deflected by the same amount, and thus the contact pressure and transmission forces are at least approximately the same.

The bearing housing of the idler pulley is preferably free and adapted to move against a supply force, provided by a spring, in the direction of the thread line. Thus when the twist is changed from S to Z, or when the crossing angle is adjusted, it will not be necessary to separately adjust the position of the bearing housing for the idler pulley. Rather, the idler pulley automatically adapts its position to correspond to the belt length, and it tensions the belt adequately by the force of the spring. The spring preferably has a constant force-distance characteristic, and also, this spring may comprise a parallel leaf spring, one end of which is fixedly mounted to the frame of the apparatus, and the other end of which connects to the bearing housing of the idler pulley. In order to provide the same belt tension for both S and Z twist, the suspension of this spring is preferably arranged by mounting in one of two operative positions on the frame of the apparatus.

In one preferred embodiment, both the support member for main whorl and drive pulley, and the bearing housing for the idler pulley are located at respective opposite ends of a common parallel leaf spring which is fixedly mounted to the frame at an intermediate location.

As noted above, the present invention is adapted for a friction false twisting apparatus of the type composed either of two endless belts which cross each other, or two rotating circular discs. In the case of two crossing belts, one of the mounting rollers for each pair of belts carries a belt pulley and the friction belts are so arranged that the plane of contact of the friction belts is essentially parallel to the plane defined by the tangential drive belt which contacts the main whorl. In the embodiment with two rotating discs, the discs are aligned in a plane perpendicular to the plane of the tangential belt.

As disclosed in copending application Ser. Nos. 168,734, and 168,735, particularly favorable results are achieved when a pressure applying member is positioned to press at least one of the belts, or one flexibly constructed disc, against the other twist imparting member.

The belt drive system of the present invention renders it possible that the crossing angle, in both the belt and disc embodiments, may be readily adjusted without requiring a corresponding adjustment of the belt guidance system or belt tension. Furthermore, the twist may be changed between S and Z, while maintaining the thread line essentially unchanged.

Figure 2A:
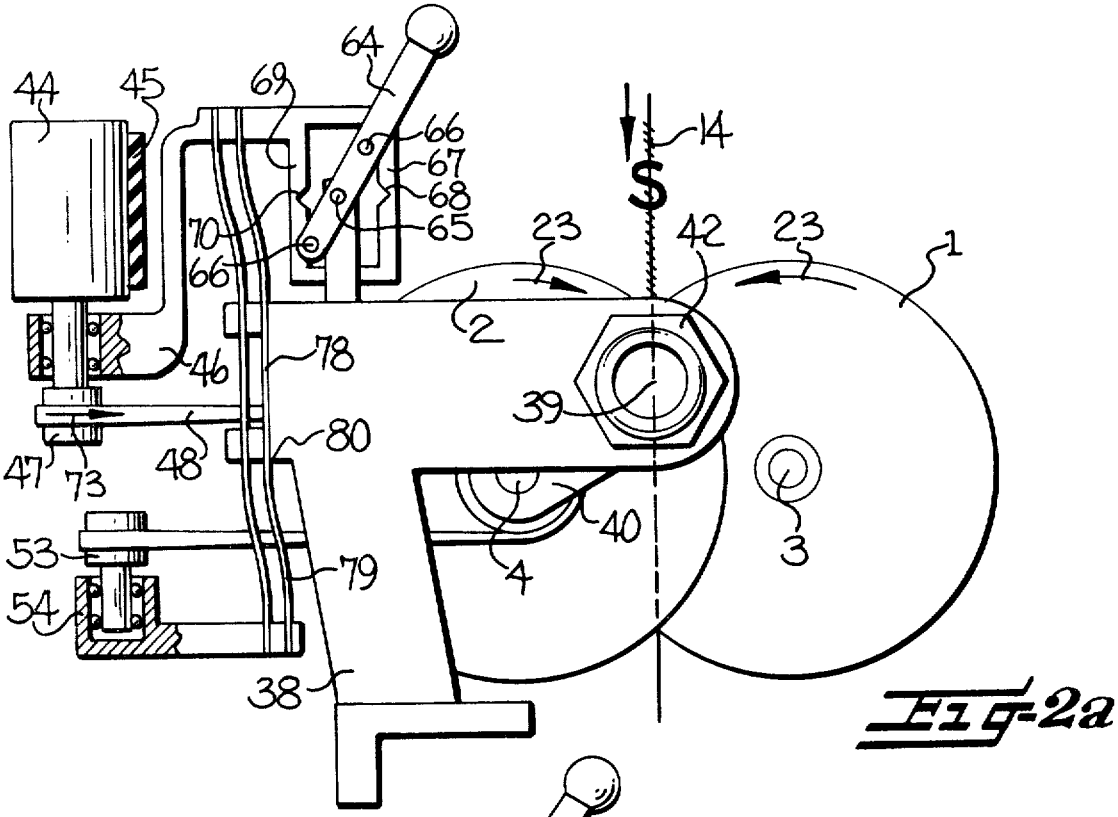
Figure 2B:
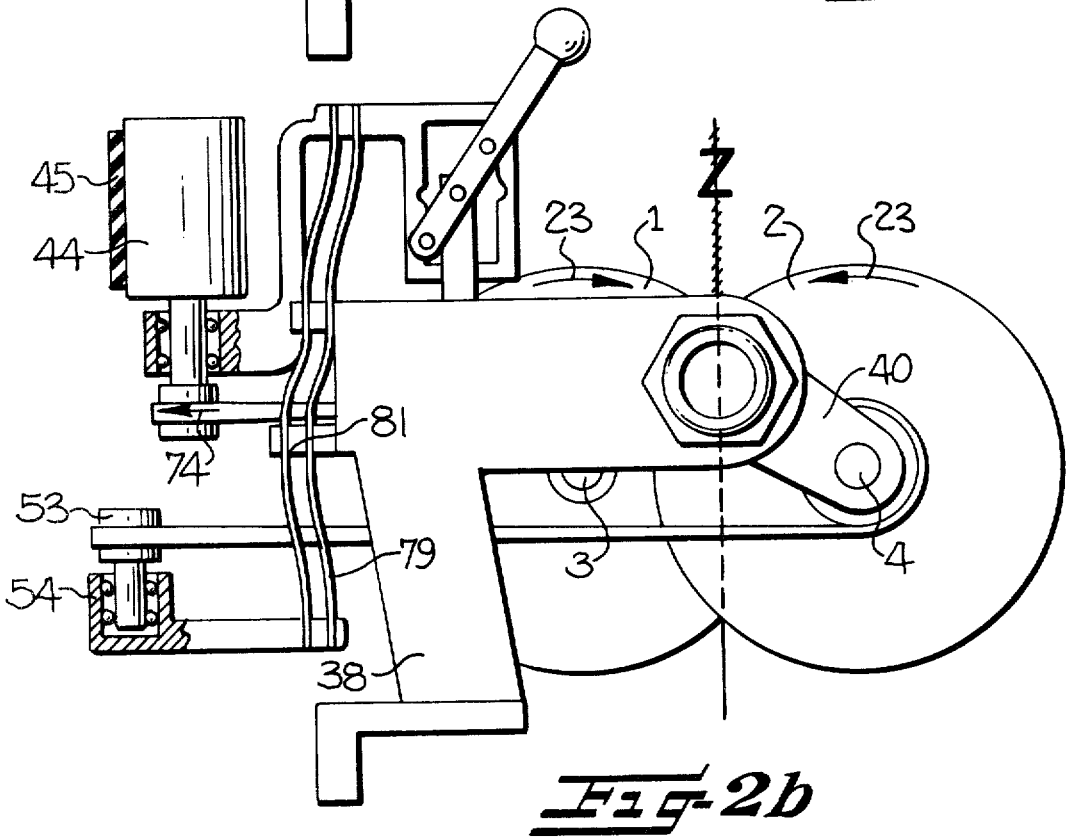
Figure 3A:
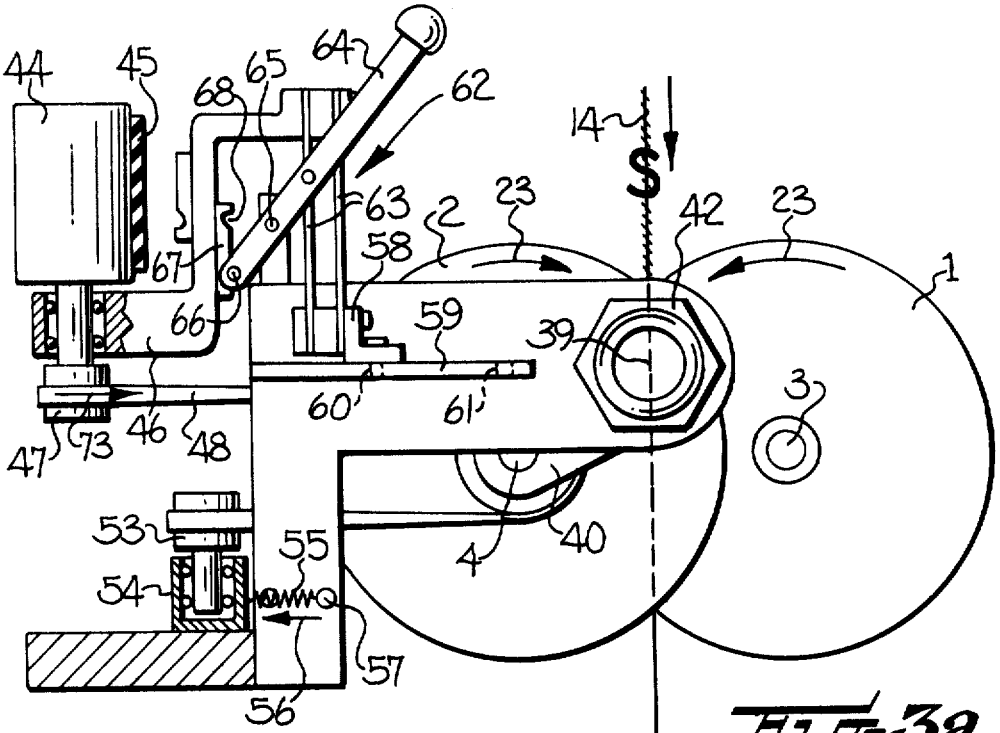
Figure 3B:
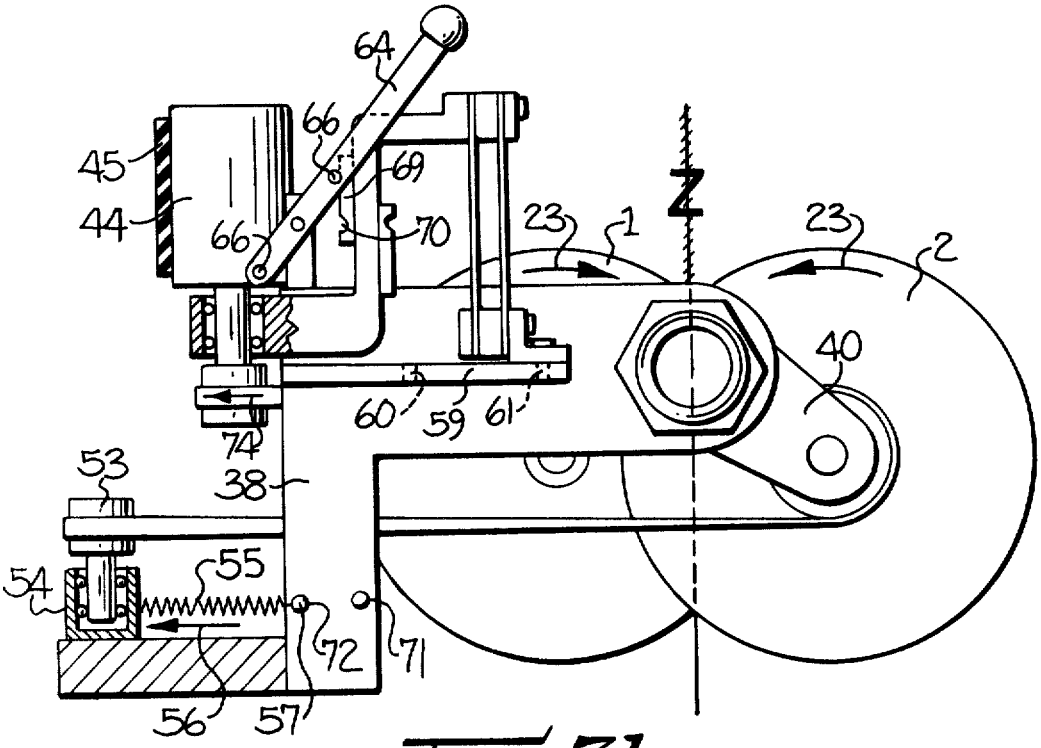
Figure 4:
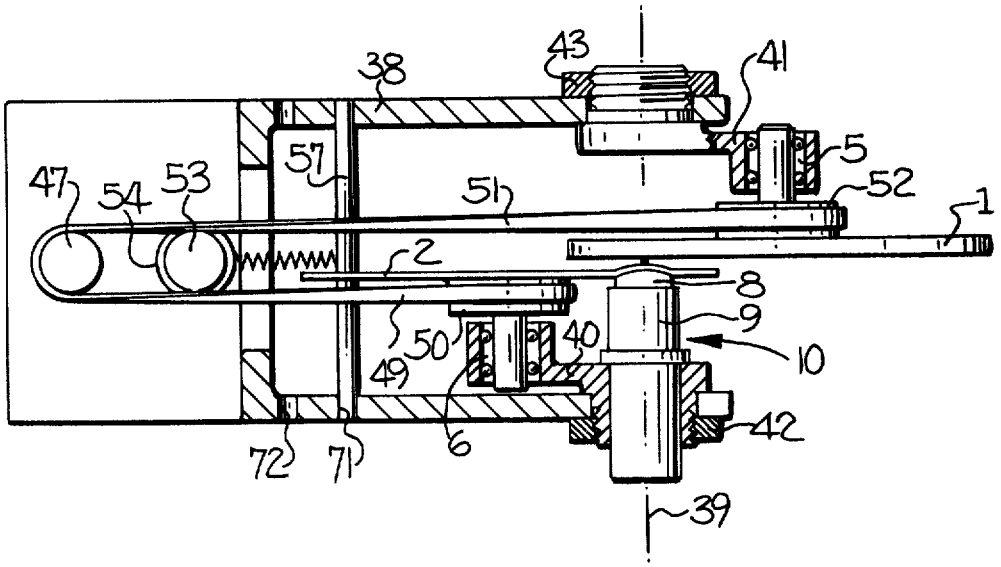
Figure 5:
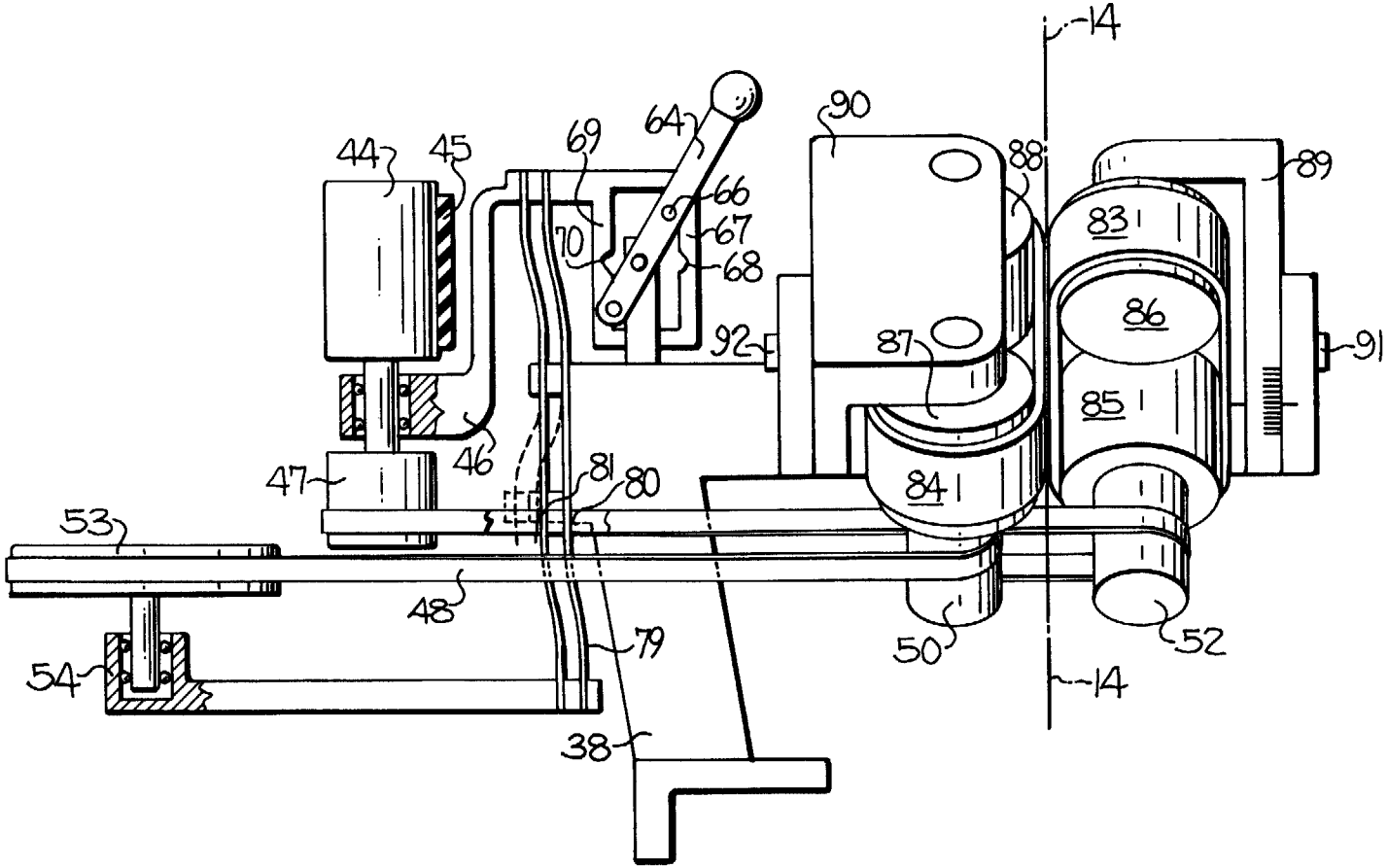

Some of the objects and advantages of the invention having been stated, others will appear as the description proceeds, when taken in connection with the accompanying drawings, in which:

FIG. 1 is a schematic perspective view of a drive system for a yarn false twisting apparatus in accordance with the present invention;

FIG. 2*a* is a side elevation view, partly sectioned, of a further embodiment of the present invention and which is adapted to impart an S twist;

FIG. 2*b* is similar to FIG. 2*a*, but with the apparatus being oriented to impart a Z twist;

FIG. 3*a* is a side elevation view, partly sectioned of still another embodiment of the present invention, and which is adapted to impart an S twist;

FIG. 3*b* is a view similar to FIG. 3*a*, and illustrating the apparatus oriented for imparting a Z twist;

FIG. 4 is a sectional top plan view of the apparatus shown in FIG. 3*a*; and FIG. 5 is a side elevation view of a further embodiment of the present invention and wherein the twist imparting members are in the form of endless belts.

Referring more specifically to the drawings, FIG. 1 schematically illustrates a drive system for a friction false twisting apparatus in accordance with the present invention, with the twist imparting members not being shown. The twist imparting members may comprise, for example, two circular discs which are connected to the belt pulleys 50 and 52 in a fixed manner, so as to be supported between them. The yarn is nipped between the front opposing surfaces of the discs in a generally known manner. Alternatively, the twist imparting members may comprise two endless belts, which engage the yarn between opposing segments and which are each entrained about a pair of rollers. One roller of each of these pairs is fixedly connected with one of the pulleys 50 and 52. With these two types of friction false twisting members, the angle at which the friction surfaces cross each other in the twisting zone, may be adjusted by changing the relative positions of the pulleys 50 and 52.

The friction false twisting apparatus is driven by a tangential belt 45 which extends the length of the machine and runs in a common direction therealong. The tangential belt 45 drives the main whorl 44 which together with a coaxial drive pulley 47 is freely rotatable in the whorl support member 46. The bearing housing 54 contains a freely rotatable reversing or idler pulley 53. The drive pulley 47 is looped by one reach of an endless drive belt 48, and the idler pulley 53 is looped by the other reach of the belt. Further, each reach of the belt 48 winds around the pulleys 50 and 52 as shown in FIG. 1. Both the support member 46 of the main whorl 44 and the housing 54 of the idler pulley 53 are movably mounted on the frame of the friction false twisting apparatus, in a direction which is perpendicular to the running direction of the tangential belt 45 and perpendicular to the running direction of the yarn (which is not shown in FIG. 1). It is thus insured that the drive belt 48 is always taut, and that the deflection which the whorl 44 is subjected to when contacted by the tangential belt 45 does not result in a change of the running direction of the yarn.

The support member 46 is pressed against the tangential belt 45 by a spring 75 and can be removed from it by a movable stop 76. The bearing housing 54 for the idler pulley 53 is pressed toward the tangential belt 45 by a spring 77 whose force is smaller than that of the spring 75, and thus a sufficient tautness of the drive belt 48 is achieved.

It should be noted that it is also possible to move the support member 46 toward the tangential belt 45 by means of a movable stop, so that a contact between the tangential belt 45 and main whorl 44 is achieved by the stop, and the removal of the main whorl from the tangential belt is achieved by means of a spring. Such a mechanism is described below in greater detail.

With respect to the embodiments illustrated in FIGS. 2 to 4, it will be understood that the following description relates to both embodiments, unless an embodiment is explicitly pointed out as being referenced.

The illustrated friction false twisting apparatus of FIGS. 2 to 4 comprises a rigid disc 1 and a flexible disc 2. Both discs are rotatable on the shafts 3 and 4 in mountings 5 and 6 respectively, and are driven by a drive system which includes the pulleys 50 and 52. The rigid disc is provided with a friction coating which can be rubber, Vulkollan, a wear resistant metal, a plasma coating, a ceramic coating, a nickel-diamond coating, and the like. The flexible disc consists of a material or a compound material which absorbs the tensile forces caused by centrifugal force, and which at the same time may be readily deflected or upset in the lateral direction. The flexible disc may for example be a rubber disc having a thickenss of 0.5 to 2 mm, and having a cord thread embedded in its rubber layer to increase its tensile strength.

A pressure applying member 10 acts upon the back surface of the flexible disc 2 (note FIG. 4) by means of a pressure surface 8 so that the flexible disc is upset toward the yarn 14. Thus, the yarn is clamped between the flexible disc 2 and the annular friction surface of the rigid disc 1. The pressure applying member consists of a cylinder 9 and a piston 8 moving therein, which piston contacts the flexible disc 2. Further, a pressurized air connection may be provided (not shown) and which causes the piston to be moved toward the flexible disc. Further details regarding the pressure applying member may be obtained by reference to the above-noted copending application Ser. Nos. 168,734 and 168,735.

The yarn 14 is fed to the friction false twist apparatus by way of a thread admitting guide (not shown) in a direction perpendicular to the plane which is common to the two axes of rotation of the discs 1 and 2. The mountings 5 and 6 may be displaced, whereas the pressure applying member 10 is fixed with respect to the frame. Thus, the discs are movable between the extreme operational positions, with the discs being positioned such that the two shafts or axes of rotation have the same distance from the thread line.

The discs may also be displaced in order to switch between an S twist and a Z twist, or to change the ratio of twist to yarn advance. For clarification, it should be noted that between the extreme operational positions of the discs, any intermediate position may be chosen which is advantageous for the desired false twist method.

FIGS. 2*a* and 2*b*, as well as 3*a* and 3*b*, present the side elevation view of the false twist apparatus, which is also presented in FIG. 4 as a sectional view. With the discs rotating in the directions indicated by the arrows 23, an S twist is imparted to the yarn with the friction discs 1 and 2 positioned as illustrated in FIGS. 2*a*, 3*a* and 4, and a Z twist is imparted with the friction discs positioned as illustrated in FIGS. 2*b* and 3*b*. The friction false twist apparatus shown in these figures includes the frame 38, which is U-shaped in its transverse section as best seen in FIG. 4. One arm of this U-shaped frame 38 mounts the pressure applying member 10 as described above.

The rocking arms 40 and 41 are pivotally supported between the arms of the U-shaped frame 38 for pivotal movement about a pivotal axis 39 which corresponds to the axis of the pressure applying member 10. The arms may be secured in a selected position by the nuts 42 and 43. The housings 5 and 6 for the discs 1 and 2 are positioned in the ends of the rocking arms.

The friction false twisting apparatus is driven by tangential belt 45, which extends in a horizontal direction along the apparatus, and runs at a constant speed and in a single direction. The belt 45 is in contact with the main whorl 44 of the friction false twist apparatus, and is rotatable in the whorl support member 46. Further, the shaft of the main whorl 44 carries the drive pulley 47. The drive pulley 47 is looped by the endless belt 48, which then winds about the pulley 50 of the friction disc 2 with the segment 49 and around the pulley 52 of the friction disc 2 by the segment 51. Thereafter, the belt returns to the freely rotatable idler or reversing pulley 53. The bearing housing 54 is movable in the belt stretching direction 56, and is pressed in this direction by a spring 55 as shown in FIGS. 3*a* and 3*b*. In the embodiment of FIGS. 2*a* and 2*b*, the bearing housing 54 is pressed in the stretching direction by the lower part 79 of the parallel leaf spring 78. The pressure spring 55 is supported on the frame by means of the bolt 57, and the parallel spring 78 can be suspended in the position 80 or 81.

In FIG. 2*a*, the whorl support member 46 is supported at the upper free end of a parallel leaf spring 78, and in FIG. 3*b*, it is supported at the upper free end of the parallel leaf spring 62. By means of a connection piece 58, the parallel leaf spring 62 in FIG. 3*a* can be fixed on the guide plate 59 in one of two positions 60 and 61. The parallel spring 62 consists of two parallel spring plates 63 whose ends are firmly fixed to each other so that the spring plates 63 are able to move only in a parallel direction, from their rest position. In operation, the main whorl 44 is pressed against the tangential belt by the force of the parallel spring, whereas spring 55 or the lower part 79 of the parallel spring 78 insures the automatic setting of the position of the idler pulley 53 and maintenance of the tautness of the belt as shown in FIG. 2*a*.

Lever arm 64 serves to withdraw the main whorl 44 from the tangential belt 45. The lever arm 64 is pivotally mounted in the pivot 65 on the frame 38. A bolt is mounted at the operative end of the lever arm, which slides on a slide piece 67 having a notch 68. In the position shown in FIGS. 2*a*, 3*a*, the whorl 44 is pressed against the tangential belt 45 by the force of the parallel spring 62. When the bolt is received into the notch 68, the whorl 44 is separated from the tangential belt 45.

FIGS. 2*b* and 3*b* illustrate the operational position of the apparatus for Z twist formation. In FIG. 3*b*, the connection piece 58 is mounted in position 61, and the whorl support member 46 and lever arm 64 are thereby oriented with another slide piece 69 having a notch 70. For removing the whorl 44 from the drive belt 45 in this configuration, i.e., for interrupting the operation of the apparatus, the bolt 66 is inserted into the other eye on the lever arm 64, which other eye is in operative contact with the slide piece 69, so that it may be received in the notch 70. In order to maintain a constant tightness of the belt, the securement point for the pressure spring 55 can be adjusted, upon moving the whorl support member from position 62 to position 61. This is accomplished by lifting the bolt 57 from the eye 71, and inserting it into the eye 72.

It should be noted that the pressure spring 55 has a level force characteristic so that the force exerted by the spring is independent of the spring displacement within the limits given by the operational positions.

With the friction discs positioned as shown in FIGS. 2*a*, 3*a*, the thread receives an S twist. Thus, the twisting zone, i.e., the area determined by the twist imparting members, and upon which the yarn is in frictional contact therewith, is maintained stationary. However, it may also be displaced relative to the discs by changing the angular position of the rocking arms 40 and 41 with respect to each other. It should be noted that the frame 38 may be equipped with suitable guide brackets (not shown) for synchronizing the movement of the arms 40 and 41.

In order to switch the twist formation from S twist to Z twist, the relative positions of the discs are changed such that the disc 2 lies to the right and the disc 1 to the left of the yarn path of travel, as can be seen in FIGS. *2b* and *3b*. Concurrently, the whorl 44 is moved from its position on the left side of the tangential belt 45 as shown in FIG. *3a* to the position on the right side of the tangential belt as illustrated in FIG. *3b*, without changing the direction of the run of the belt. For this displacement of the whorl, the connection piece 58 is moved from position 60 into position 61 as shown in FIG. *3b*. In FIG. *2a*, the parallel spring 78 is suspended such that the extent of movement of this spring is equal in both operational positions. To further interrupt operation of the friction false twist apparatus, the whorl may be withdrawn from the tangential belt by shifting the bolt 66 in the lever 64 to that eye which is in operative contact with the slide piece 67 and notch 68, or with slide piece 69 and notch 70. Due to the displacement of the whorl, the direcion of run of the endless belt 48 is changed from the direction 73 to the direction 74 as shown in FIG. *3b*, so that the rotary direction of the discs 1 and 2 also changes. In order to maintain the tautness of the belt, the bolt 57 of the pressure spring 55 is removed from the eye 71 and inserted into the eye 72 as seen in FIG. *3b*, and as shown in FIG. *2b*, the suspension of the lower part of the parallel spring 78 is moved from position 80 to position 81 so that the amount of movement remains at least approximately the same.

Referring now to the embodiment of FIG. 5, it will be understood that the description of the embodiment of FIG. *2a*, *2b* may be referenced, as these two embodiments correspond in many respects with each other. In particular, the change from S twist to Z twist with regard to the drive system is the same. However, in the embodiment of FIG. 5, the twist imparting members comprise endless friction belts 83 and 84, and wherein the yarn 14 is engaged between one segment or run of each belt. A desirable feature of this embodiment resides in the fact that pressure applying members may be provided, which are not here illustrated, but which are described particularly in the copending application Ser. Nos. 168,734 and 168,735. The friction belts are entrained about respective pairs of rollers, consisting of the rollers 85, 86, 87 and 88. One roller of each pair, namely rollers 85 and 87 is coaxially connected to the belt pulleys 52 and 50, respectively, with the drive belt 48 being entrained about these pulleys in the manner described above. Each pair of pulleys is mounted on a supporting frame 89, 90, which is T-shaped in transverse section. The supporting frames 89, 90 are pivotable about the axes 91, 92 which are coaxially aligned with each other, and the frames are adapted to be fixed in any desired angular position. Thus it is possible to set the ratio of twist and yarn advance, and also to readily change from S twist to Z twist.

The particular advantage of the drive system of the embodiment of the invention illustrated in FIG. 5 resides in the fact that in spite of the fact of changing the angular position of the supporting frames 89, 90 during the change from S twist to Z twist, and in spite of the considerable change in the position and angular position of the pulleys 50, 52, modifications are relatively insignificant and readily accomplished. In particular, the act of reversing the drive belt 48, which is a relatively complex operation, is avoided.

In the drawings and specification, there has been set forth a preferred embodiment of the invention and although specific terms are employed, they are used in a generic and descriptive sense only and not for purposes of limitation.

That which is claimed is:

1. A yarn false twisting apparatus comprising a frame, a pair of twist imparting members, each having a generally flat yarn engaging friction surface, means mounting said members to said frame for rotational movement wherein portions of the respective yarn engaging friction surfaces are disposed in opposing relationship and define a twisting zone therebetween, drive means for operatively rotating each of said members, and such that a yarn may be advanced along a path of travel through said twisting zone while having twist imparted thereto, said drive means including (a) a drive whorl rotatably mounted in a whorl support member, (b) means mounting said whorl support member to said frame so that said drive whorl is rotatable about an axis generally parallel to the yarn path of travel through said twisting zone, and such that said drive whorl is adapted to be tangentially engaged by a main drive belt of said apparatus, (c) a drive pulley rotatably mounted in said whorl support member and operatively connected to said drive whorl for concurrent rotation therewith, (d) a belt pulley operatively connected to respective ones of said twist imparting members, (e) an idler pulley, (f) means rotatably mounting said idler pulley to said frame for rotation about an axis generally parallel to that of said drive pulley, (g) drive belt means operatively interconnecting said drive pulley, said two belt pulleys, and said idler pulley for effecting concurrent rotation thereof with rotation of said drive whorl, (h) at least one of said means mounting said whorl support housing, and said means mounting said idler pulley, being adjustable for movement with respect to said frame in a direction perpendicular to the yarn path of travel to thereby assure maintenance of an adequate tension on said drive belt means.

2. The yarn false twisting apparatus as defined in claim 1 wherein said drive belt means comprises a single endless belt.

3. The yarn false twisting apparatus as defined in claim 2 wherein said drive pulley and said drive whorl are each fixedly mounted on a common shaft and so that they rotate about a common axis.

4. The yarn false twisting apparatus as defined in any one of claims 1-3 wherein each of said means mounting said whorl support member and said means mounting said second belt pulley are adjustable for movement in a direction perpendicular to the yarn path of travel.

5. The yarn false twisting apparatus as defined in claim 4 wherein said means mounting said whorl support member includes an adjustable stop for limiting movement in one direction.

6. The yarn false twisting apparatus as defined in claim 5 wherein said means mounting said whorl support member further includes means biasing said support member against said stop.

7. The yarn false twisting apparatus as defined in any one of claims 1-3 wherein said means mounting said whorl support member includes means fixing the same at one of two operating positions, and whereby the drive whorl may be selectively positioned to be engaged on opposite sides by the main drive belt of the apparatus, to thereby reverse the direction of rotation of said twist imparting members.

8. The yarn false twisting apparatus as defined in claim 7 wherein said means mounting said whorl support member includes leaf spring means for biasing said drive whorl against the main drive belt of the apparatus.

9. The yarn false twisting apparatus as defined in claim 7 wherein said means rotatably mounting said idler pulley to said frame includes spring biasing means for urging said idler pulley in a direction to tighten said drive belt means.

10. The yarn false twisting apparatus as defined in claim 9 wherein said spring biasing means includes a spring, and means for selectively mounting the spring to said frame at one of two positions, so as to accommodate the drive belt means upon movement of said whorl support member between its two operating positions.

11. The yarn false twisting apparatus as defined in any one of claims 1-3 wherein said means mounting said whorl support member and said means mounting said idler pulley include a common leaf spring mounted intermediate its ends to said frame, with said support member mounted adjacent one end thereof and said means mounting said idler pulley mounted adjacent the other end thereof.

12. The yarn false twisting apparatus as defined in claim 11 wherein said means mounting said whorl support member further includes means fixing the same at one of two operating positions, and whereby the drive whorl may be positioned on opposite sides of the main drive belt, and said means mounting said idler pulley includes means for selectively mounting said common leaf spring to said frame at one of two operating positions to thereby permit accommodation of the drive belt means upon movement of said whorl support member between its operating positions.

13. The yarn false twisting apparatus as defined in any one of claims 1-3 wherein said twist imparting members comprise a pair of endless belts, and said means mounting said belts to said frame includes means mounting the same so as to cross each other at an adjustable angle.

14. The yarn false twisting apparatus as defined in claim 13 wherein said apparatus further comprises a pressure applying member mounted adjacent the back surface of at least one of said belts and so as to locally bias the same toward the other belt at said twisting zone.

15. The yarn false twisting apparatus as defined in claim 14 wherein said means mounting said belts to said frame includes a pair of brackets, with each bracket rotatably mounting a pair of rollers having one of said belts disposed thereabout, and means mounting said brackets to said frame for pivotal movement about a coaxial axis which is perpendicular to said yarn path of travel.

16. The yarn false twisting apparatus as defined in any one of claims 1-3 wherein said twist imparting members comprise a pair of circular discs, and said means mounting said discs to said frame includes a shaft mounted to each disc, and means mounting the shafts to said frame for rotation about parallel spaced apart axes which are essentially perpendicular to the yarn path of travel.

17. The yarn false twisting apparatus as defined in claim 16 wherein said means mounting said shafts to said frame include means permitting selective relative movement along a direction generally perpendicular to their axes of rotation.

18. The yarn false twisting apparatus as defined in claim 17 wherein each of said belt pulleys is mounted to respective ones of said shafts.

19. The yarn false twisting apparatus as defined in claim 18 wherein said means mounting said shafts to said frame includes a pair of rocking arms each rotatably receiving one of said shafts, and means mounting each of said rocking arms to said frame for pivotal movement about a common axis which is parallel to the axes of rotation of said discs and passes through said twisting zone.

20. The yarn false twisting apparatus as defined in claim 19 wherein at least one of said discs is flexible, and said apparatus further comprises a pressure applying member mounted so as to locally bias said one flexible disc toward the other disc at said twisting zone.

21. A yarn false twisting apparatus comprising a frame, a pair of twist imparting members, each having a generally flat yarn engaging friction surface, means mounting said members to said frame for rotational movement wherein portions of the respective yarn engaging friction surfaces are disposed in opposing relationship and define a twisting zone therebetween, drive means for operatively rotating each of said members, and such that a yarn may be advanced along a path of travel through said twistig zone while having twist imparted thereto, said drive means including (a) a drive whorl rotatably mounted in a whorl support member, (b) means selectively mounting said whorl support member to said frame in one of two operating positions so that said drive whorl is rotatable about an axis generally parallel to the yarn path of travel through said twisting zone, and such that said drive whorl is adapted to be tangentially engaged on either side by a main drive belt of said apparatus, (c) a drive pulley rotatably mounted in said whorl support member and operatively connected to said drive whorl for concurrent rotation therewith, (d) a belt pulley operatively connected to respective ones of said twist imparting members, (e) an idler pulley, (f) endless belt means operatively interconnecting said drive pulley, said two belt pulleys, and said idler pulley for effecting concurrent rotation thereof with rotation of said drive whorl, (g) means rotatably mounting said idler pulley to said frame in one of two operative positions and for rotation about an axis generally parallel to that of said drive pulley, and so as to permit the tension in said endless belt means to be maintained upon the whorl support member being moved to either of its operating positions.

22. The yarn false twisting apparatus as defined in claim 21 wherein movement of each of said whorl support member and said idler pulley between their respective operative positions is in a direction perpendicular to the yarn path of travel.

* * * * *